US007029309B2

(12) United States Patent
Ma

(10) Patent No.: US 7,029,309 B2
(45) Date of Patent: Apr. 18, 2006

(54) LAND GRID ARRAY ELECTRICAL CONNECTOR

(75) Inventor: Hao-Yun Ma, Santa Clara, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/001,376

(22) Filed: Nov. 30, 2004

(65) Prior Publication Data

US 2005/0130479 A1 Jun. 16, 2005

(30) Foreign Application Priority Data

Dec. 12, 2003 (TW) ..... 92221837 U

(51) Int. Cl.
*H01R 13/62* (2006.01)

(52) U.S. Cl. ..... 439/331

(58) Field of Classification Search ..... 439/331, 439/73, 342, 330, 70, 261, 525
See application file for complete search history.

(56) References Cited

U.S. PATENT DOCUMENTS 6,722,909 B1 * 4/2004 McHugh et al. ..... 439/331
6,780,041 B1 * 8/2004 Ma ..... 439/342
6,908,327 B1 * 6/2005 Ma ..... 439/331
6,929,495 B1 * 8/2005 Ma ..... 439/331
2004/0121630 A1 * 6/2004 Ma et al. ..... 439/73
2004/0229492 A1 * 11/2004 Ma ..... 439/331
2005/0112929 A1 * 5/2005 Szu et al. ..... 439/331
2005/0118856 A1 * 6/2005 Ma ..... 439/331

* cited by examiner

*Primary Examiner*—Chandrika Prasad
(74) *Attorney, Agent, or Firm*—Wei Te Chung

(57) ABSTRACT

A land grid array connector for electrically connecting a CPU package (60) to a printed circuit board includes a housing (10) received a number of contacts (12) therein, a stiffener (20) enclosingly attached to the housing, a load plate (40) and a lever (30) pivotally mounted to opposite sides of the housing respectively. The housing has a number of sidewalls. Two wings (45) extend downwardly from opposite side edges of the load plate and toward the housing. A stopping member is formed on the wings of the load plate and two opposite sidewalls of the housing corresponding the wings, for resisting horizontal moving of the load plate and the CPU chip. The stopping member comprises a plurality of protrusions and holding sections engaging the protrusions. The protrusions each engagingly retained in a corresponding holding section during the connector being in closed position. This can resist horizontal moving of the load plate and the CPU chip. Further, this thereby protects the housing from being collided and scraped by motion of the CPU chip. As a result, reliable electrical connection between the CPU chip and the contacts of the connector is obtained.

8 Claims, 5 Drawing Sheets

LAND GRID ARRAY ELECTRICAL CONNECTOR

BACKGROUND OF THE INVENTION

1. Field of the Invention

The present invention relates to electrical connectors, and more particularly to a land grid array (LGA) connector for electrically connecting an electronic package such as a CPU chip, to a circuit substrate such as a printed circuit board (PCB).

2. Description of the Prior Art

LGA connectors are commonly used in personal computer (PC) systems, for electrically connecting CPU chips to PCBs. This kind of connectors can avoid soldering procedures during being mounted on the PCBs.

FIGS. 4 and 5 show such a conventional LGA connector of this kind for electrically connecting a CPU chip 100 to a PCB (not shown). The LGA connector 8 comprises an insulative housing 82 receiving a plurality of contacts 81 therein, a stiffener 83 attached to the housing 82 and having two locking openings 89, a load plate 84 and a lever 85 pivotally mounted to two opposite sides of the housing 82 respectively. A pair of clasps 87 is formed on one side of the load plate 84. The clasps 87 engage with the locking openings 89 of the stiffener 84, for hinging the load plate 84 to the stiffener 83. A tongue portion 90 extends from a side of the load plate 84 opposite to the clasps 87. The tongue portion 90 comprises a slanted section 902 and an engagement section 904. The lever 86 comprises a locating portion 85 with a cam portion 850.

In use, the CPU chip 100 is disposed on the housing 82. The load plate 84 is pressed down onto the CPU chip 100, pressing portions (not numbered) of the load plate 84 resting on the CPU chip 100. The lever 86 is rotated down from a vertical position to a horizontal position, engaging with the tongue portion 90 of the load plate 84. During the rotation, the cam portion 850 of the lever 86 first presses the slanted section 902 of the tongue portion 90, pushing the load plate 84 sliding toward direction of the side the clasps 87 extending therefrom. Being continued rotating, the cam portion 850 engages with and presses the engagement section 904, pushing the load plate 84 sliding to direction of an opposite side the tongue portion 90 extending therefrom.

Because the load plate 84 compresses the CPU 100, the CPU chip is liable to move horizontally during the load plate 84 sliding. Thus, horizontal displacement of the CPU chip 100 occurs. And this can damage effective electrical connection between the CPU chip 100 and the contacts 81 of the housing 82. Further, the moving of the CPU chip 100 may cause the CPU chip 100 to collide and urge inner surfaces of the housing 82. Accordingly, scraping damage of the inner surfaces of the housing 82 happens. The scraped-away particulates of the housing 82 are prone to drop into the housing 82 and to block up the CPU chip 100 upwardly. This can adversely effect firm electrical connection between the CPU chip 100 and the contacts 81 near the scraped-away particulates. As a result, reliability of the electrical connection between the CPU chip 100 and the contacts 82 of the housing 81 is accordingly decreased.

Therefore, a new land grid array electrical connector which overcomes the above-mentioned disadvantages of the prior art is desired.

SUMMARY OF THE INVENTION

Accordingly, a main object of the present invention is to provide a new LGA connector, whereby the connector can secure effective electrical connection between a CPU chip and contacts of the connector.

Another object of the present invention is to provide a new LGA connector, whereby the connector can prevent horizontal moving of the CPU chip and a load plate of the connector of the connector during being in a closed position.

A third object of the present invention is to provide a new LGA connector, whereby the connector can protect a housing of the connector from being collided and scraping damage by the CPU chip.

To achieve the aforementioned objects, an LGA connector in accordance with a preferred embodiment of the present invention is provided. The LGA connector comprises a rectangular insulative housing, a plurality of contacts received in the housing, a stiffener enclosingly attached to the housing, a load plate and a lever pivotally mounted to two opposite sides of the housing, respectively. The housing has a floor and a plurality of sidewalls extending upwardly from the floor. The load plate is a substantially rectangular configuration. A pair of wings extend downwardly from two opposite side edges of the load plate, toward direction to the housing. A stopping member is formed together on the wings of the load plate and two opposite sidewalls of the housing corresponding the wings, for resisting horizontal moving of the load plate and the CPU chip. The stopping member comprises a plurality of protrusions and holding sections engaging the protrusions. The protrusions each engagingly retained in a corresponding holding section during the connector being in closed position. This can resist horizontal moving of the load plate and thereby avoids horizontal sliding of the CPU chip by pressing and friction of the load plate. Further, the sidewalls of the housing can be protected from being collided and scraped by motion of the CPU chip. As a result, reliable electrical connection between the CPU chip and the contacts of the connector is obtained.

Other objects, advantages and novel features of the present invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
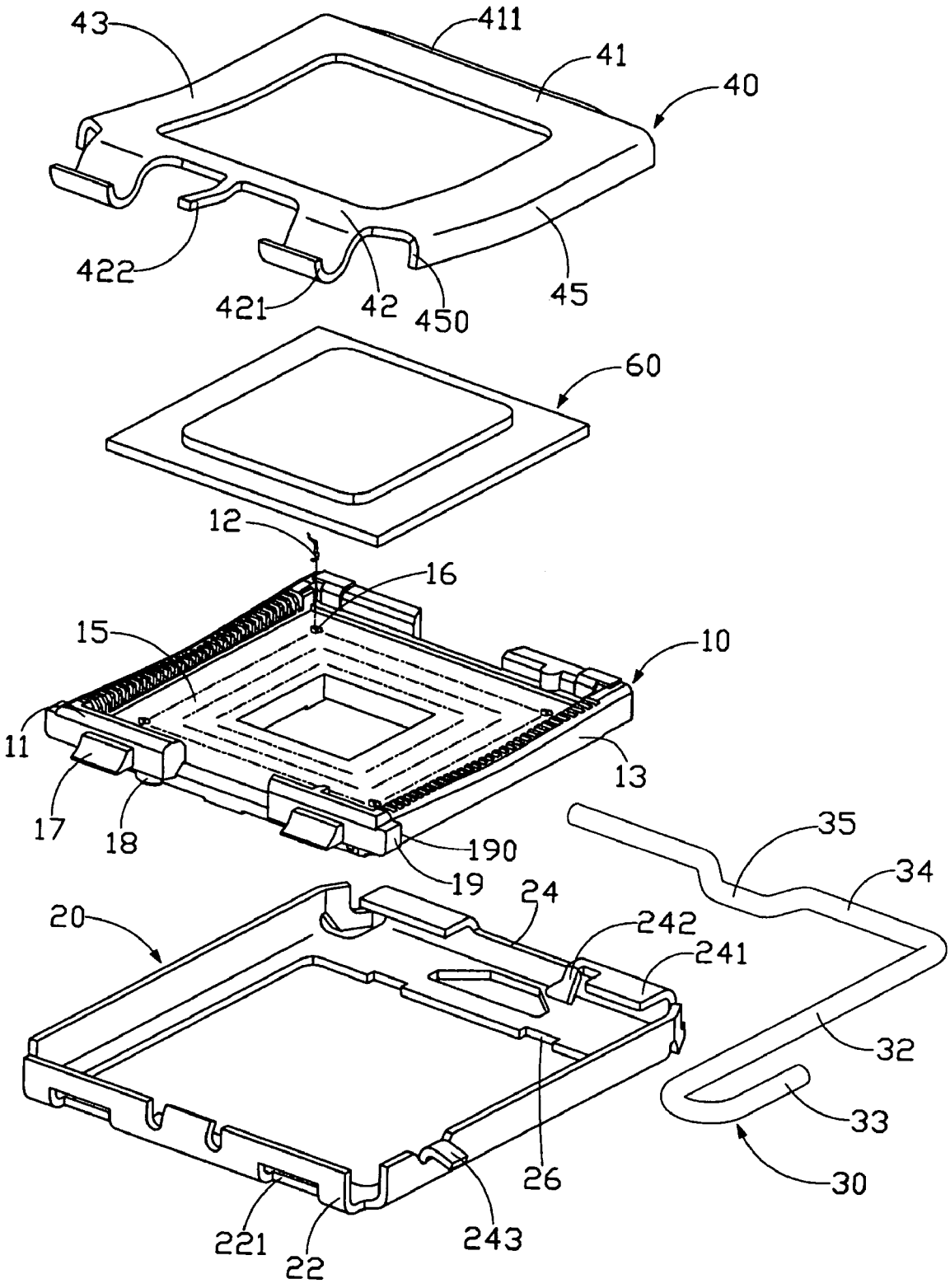
FIG. 1 is an exploded, isometric view of an LGA connector in accordance with a preferred embodiment of the present invention.
Figure 2:
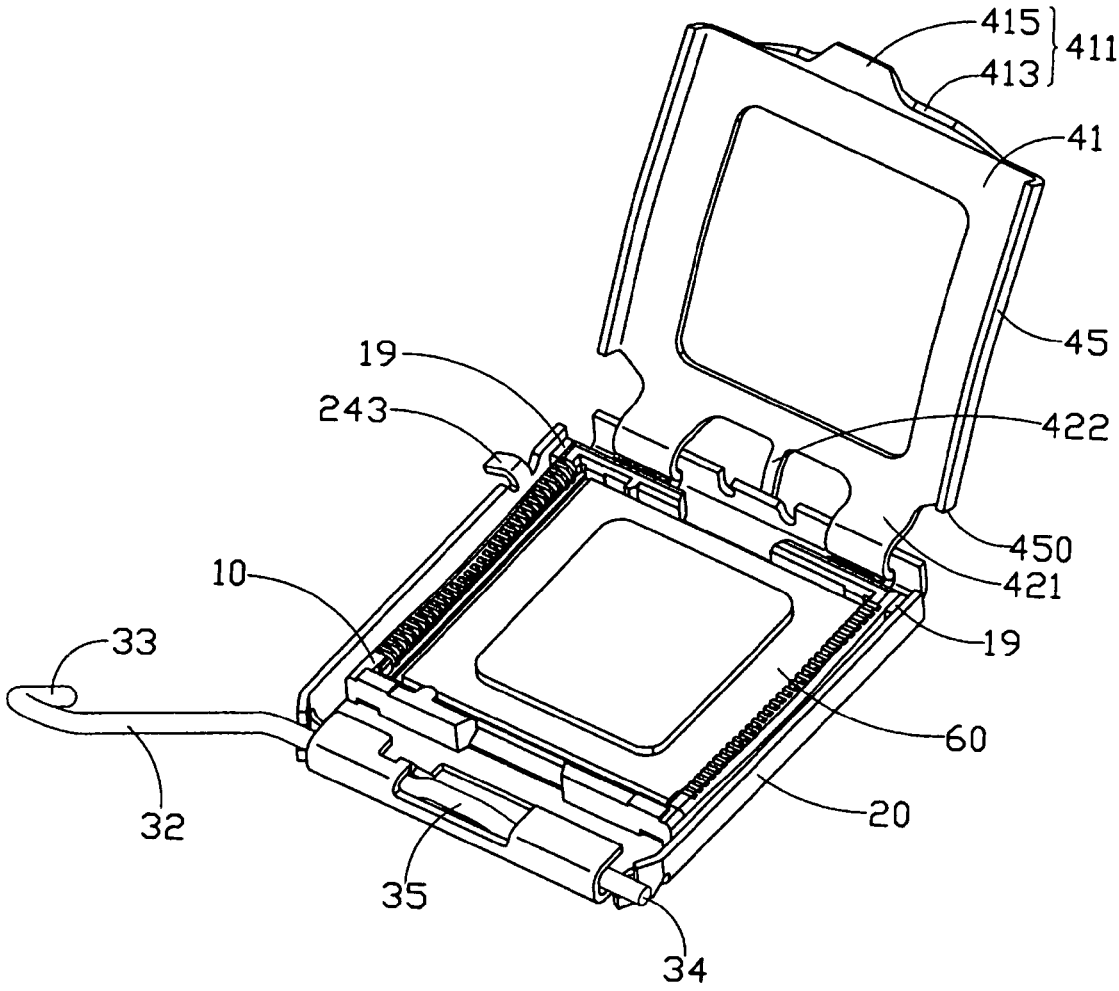
FIG. 2 is an assembled, isometric view of the LGA connector of FIG. 1, showing the LGA connector being in open position.
Figure 3:
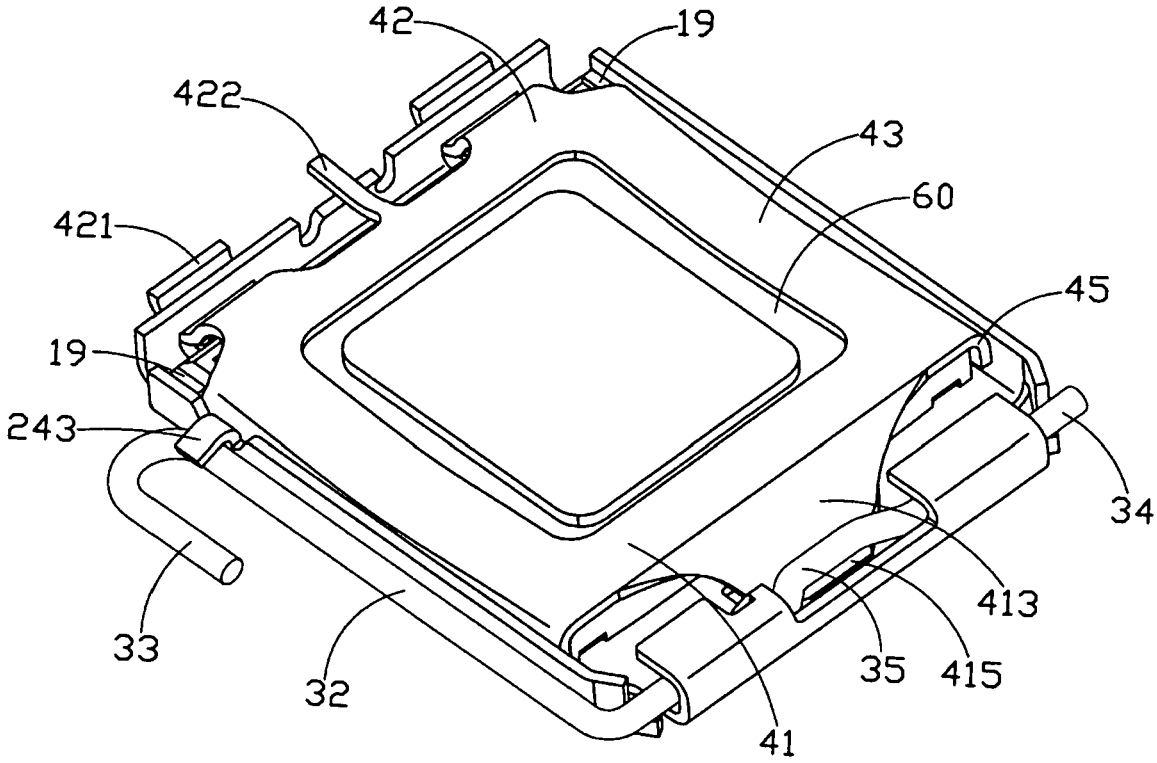
FIG. 3 is similar to FIG. 2, but showing the LGA connector being in closed position.
Figure 4:
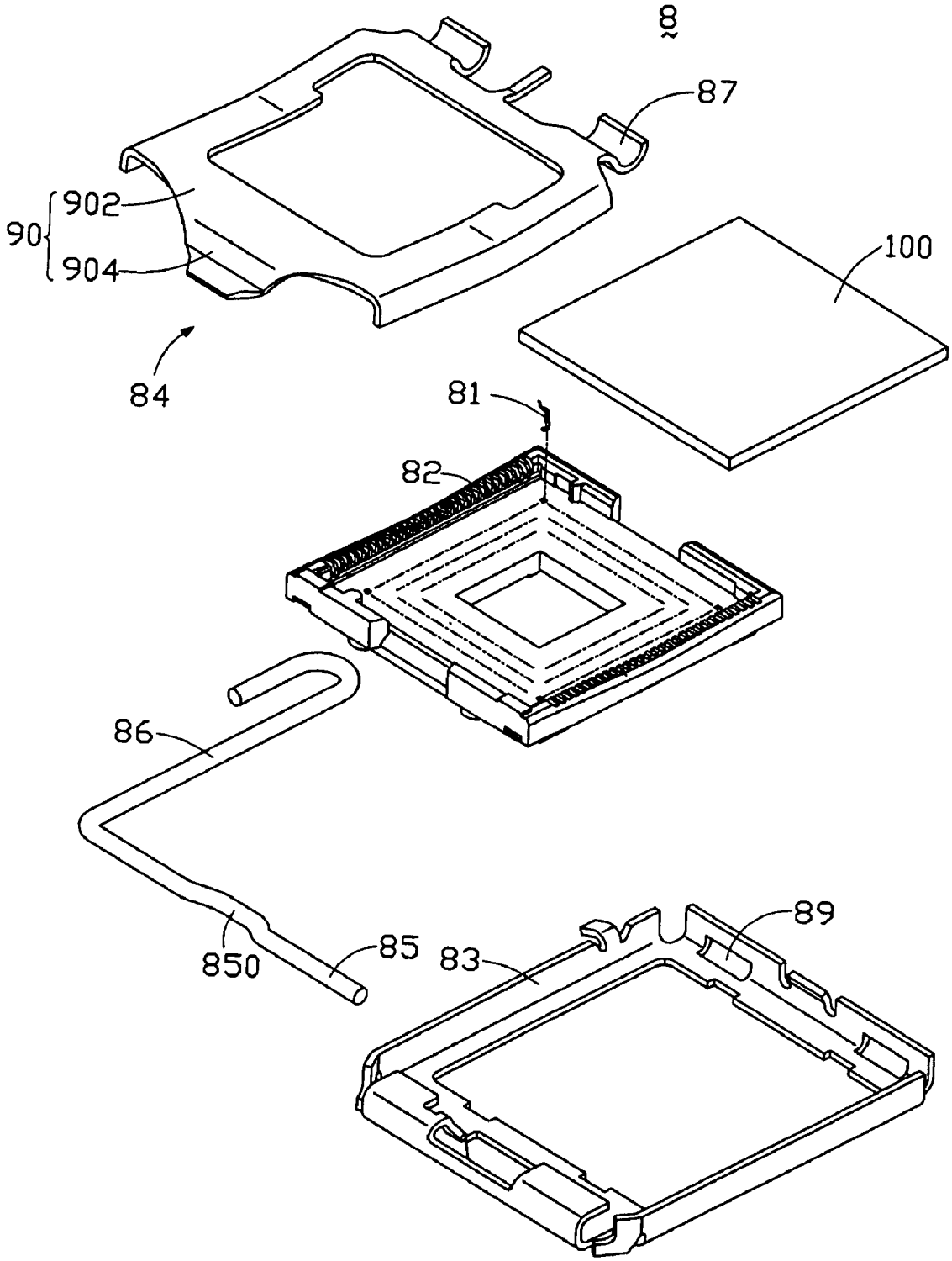
FIG. 4 (PRIOR ART)
FIG. 4 is an exploded, isometric view of a conventional land grid array connector.
Figure 5:
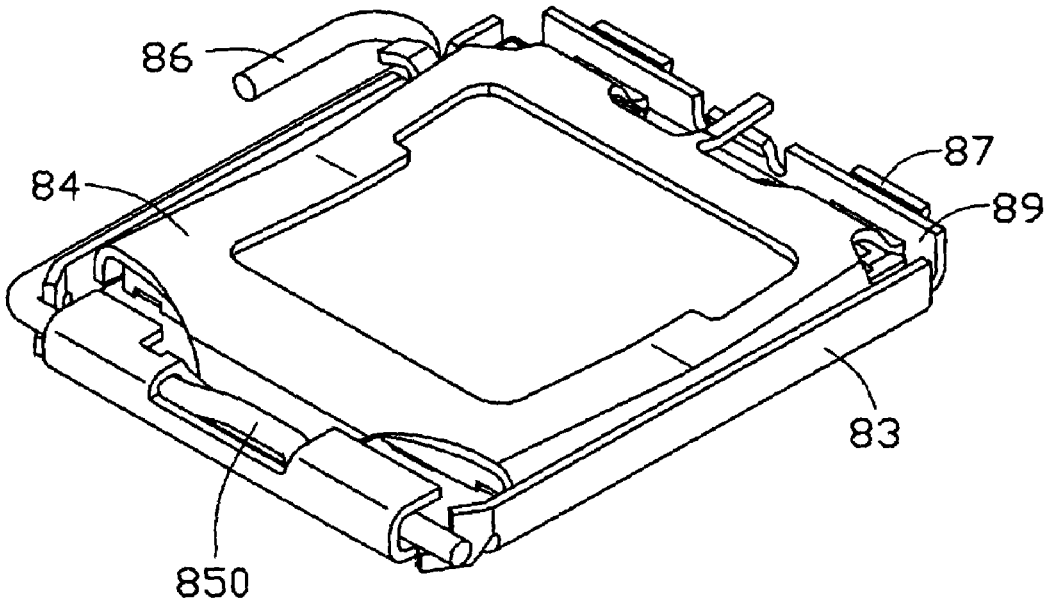
FIG. 5 (PRIOR ART)
FIG. 5 is an assembled, isometric view of the conventional LGA connector of FIG. 4.

Referring to FIGS. 1 to 3, an LGA connector in accordance with a preferred embodiment of the present invention is provided for electrically connecting a CPU chip 60 to a PCB (not shown). The LGA connector comprises a rectangular insulative housing 10 with a plurality of contacts 12 received therein, a stiffener 20 attached to and enclosing outside the housing 10, a lever 30 and a load plate 40 pivotally mounted to opposite sides of the stiffener 4, respectively.

The housing 10 is configured with a floor 15, a first sidewall 11 extending upwardly from one side edge of the floor 15, a second sidewall (not numbered) opposite to the first sidewall 11 and two opposite third sidewalls 13 interconnecting with the first and second sidewalls. A plurality of passageways 16 is defined in the floor 15, each passageway 16 receiving a corresponding contact 12 therein. The contact 12 extend beyond the floor 15, for engaging a corresponding pad (not shown) on a bottom of the CPU chip 60. A plurality of locating projections 18 is formed on a bottom surface of the housing 10, for fixing the housing 10 to the stiffener 20. A pair of locking blocks 17 protrudes from an outside surface of the first sidewall 11, for abutting against and fastening the load plate 40 attached thereon. A protrusion 19 is formed on an end of each of the third sidewalls 13, the protrusion 19 adjacent the first sidewall 11. The protrusion 19 integratively projects from an exterior surface of the third sidewall 13. The protrusion 19 has a lateral abutting surface 190 adjacent the exterior surface of the third sidewall 13. Protrusions 19 formed on the two third sidewalls 13 are symmetry from each other.

The stiffener 20 is generally a rectangular frame, which has four integrated sides (not numbered). The stiffener 20 comprises a first and second baffle 22,24 extending upwardly from external side edges of two opposite sides, and two opposite third baffles (not numbered) between the first and second baffles 22,24. In assembly, the first baffle 22 aligned with the second side 42 of the load plate 40 and the second baffle 24 is adjacent the first side 41. A pair of locking openings 221 is defined on the first baffle 22. The locking openings 221 mate with the clasps 421 of the load plate 40, for hinging the load plate 40 on the stiffener 20. Two separated clipping pieces 241 deflect from two ends of a top edge of the second baffle 24, extending toward the first baffle 22. A fastening piece 242 extends downwardly from a free end of one of the clipping pieces 241, near the other clipping piece. The clipping pieces 241 and the fastening piece 242 cooperatively engage with the locating portion 34, for hinging the lever 30 to the second baffle 24 of the stiffener 20. A semi-arc hook 243 is formed on one of the third baffles, for locking the lever 30 in a closed position.

The lever 30 is substantially a crank. The lever 30 has an operation portion 32, a locating portion 34 substantially perpendicular to the operation portion 32. A handle 33 bent from a free end of the operation portion 32, for facilitating actuating the lever 30. An offset cam portion 35 formed at a middle of the locating portion 34, paralleling to the locating portion 34. The locating portion 34 is pivotally mounted on one side of the load plate 40. The operation portion 32 is driven to move the connector between an open position and a closed position.

The load plate 40 is generally a rectangular configuration. The load plate 40 has first and second sides 41,42, and two opposite third sides 43 interconnecting the first and second sides 41,42. A semi-arc tongue portion 411 extends from a middle portion of the first side 41. The engaging portion 411 comprises a slanted section 413 adjacent the firs side 41 and an engaging section 415 connecting with the slanted section 413. A pair of spaced clasps 421 symmetrically extends outwardly from the second side 42. The clasps 421 each have a semicircular cross section, the clasps 421 rotatablely mounted to the stiffener 20. A fastening leg 422 is formed between the clasps 421, for fixing the load plate 40 on the stiffener 4. The locking blocks 17 of the housing 10 abut against inner surface of the clasps 421, for fastening the load plate 40 on the housing 10. A pressing portion 44 protrudes from a middle portion of each of the opposite third sides 43 and toward direction to the housing 10. A wing 45 integratively extends downwardly from a lateral edge of the third side 43 toward the housing 10. A holding section 450 is formed in the wing 45, the holding section 450 being aligned with the protrusion 19 of the housing 10. The holding section 450 and the protrusion 19 engagingly cooperative to form a stopping member, for preventing horizontal moving of load plate 40 during the connector being in closed position. The wing 45 abuts on the third sidewall 13 and the abutting surface 190 of the protrusion 19 resisting against the holding section 450.

In assembly, the load plate 40 and the lever 30 are separatively mounted to the first and second baffle 22,24. The load plate 40 is rotated to open position. Then the housing 10 is inserted into the stiffener 20, the fixing protrusions 18 of the housing 10 mating with the cutouts 26 of the stiffener 20. The baffles of the stiffener 20 cover outside of the sidewalls of the housing 10. Thus, the housing 10 is retained in the stiffener 20.

In use, once the CPU chip 60 is positioned on the housing 20, the load plate 40 is rotated down onto the CPU chip 60. Then the lever 30 is rotated down from a vertical position to a horizontal position, engaging with the tongue portion 411 of the load plate 40. During this process, the cam portion 35 of the lever 3 firstly presses the slanted section 413 of the tongue portion 411, applying a force to the load plate 40 and pushing the load plate 40 to direction toward the second side 42. The protrusion 19 of the housing 10 engaging retained in the holding section 450 defined in the lateral wing 45. The abutting surface 190 of the protrusion 19 resisting against the wing 45 of the load plate 40, executing a resisting force on the load plate 40 toward direction opposite to the second side 42. As the force produced by the protrusion 19 is opposite to the force applied by the lever 3, this can prevent the load plate 40 from horizontal moving toward direction to the second side 42 during this process.

The lever 30 is continuingly rotated down to the horizontal position, the cam portion 34 presses the engagement section 415 of the tongue portion 411. The pressing portions 43 of the load plate 40 compress the CPU chip 3 downwardly. Because the load plate 40 does not move toward direction to the second side 42 firstly, it will not move toward direction opposite to the second side 42 to return its original position. This can avoid the CPU chip 60 from horizontal sliding toward direction to the first side 41 caused by compression and friction of the load plate 40. And this can further protect the housing 10 from scraping damage caused by colliding and scraping of the CPU chip 60. As a result, reliable electrical connection between the CPU chip 3 and the contacts 12 of the housing 10 is secured.

The above-described embodiment shows that the stopping member is composed of the protrusion 19 and the holding section 450 engaging with the protrusion, and the protrusion 19 being formed on the third sidewall 13 of the housing 10, while the holding section 450 being defined on one end of the wing 45. It should be understood that the stopping member may have other alternative configuration. For one example, the holding section 450 may be a plurality of separated slots defined in the wings 45, while a plurality of protrusions 19 projects outwardly from the external surfaces of the third sidewalls 13 of the housing 10. The slots each engagingly retain a corresponding protrusion 19 formed on the housing 10 therein during the connector being in closed position. Further, the slots can also be defined in the opposite third sidewalls 13 of the housing 10, while the protrusions 19 are formed on the wings 45 of the load plate 40 and protrude downwardly toward the housing 10. In these circumstances, the protrusion 19 extend out from and engagingly retained in a corresponding slot during the load plate 40 is rotated from open position to closed position. This also can avoid the load plate 40 from horizontal moving during the rotating. Thus, horizontal moving of the load plate 40 and the CPU chip 60 is resisted. And this thereby avoids colliding and scraping damage of the housing 10 by motion of the CPU chip. As a result, effective electrical connection between the CPU chip 60 and the contacts 12 of the connector is secured.

While the present invention has been described with reference to a preferred embodiment, the description is illustrative and is not to be construed as limiting the invention. Therefore, various equivalent modifications and changes known to persons skilled in the art according to the spirit of the present invention are considered within the scope of the present invention as defined in the appended claims.

What is claimed is:

1. An electrical connector comprising:

an insulative housing having a floor, a plurality of sidewalls extending upwardly from the floor and a receiving space cooperatively defined by the floor and the sidewalls for accommodating an electrical package therein;

a plurality of contacts secured on the housing;

a stiffener enclosingly attached to the housing;

a load plate and a lever being hinged to two opposite sides of the housing, the load plate having two wings depending from two opposite side edges thereof, the wings extending downwardly toward the housing, the wings covering outsides of two opposite sidewalls of the housing corresponding the wings when the load plate being in closed position; and a stopping member formed on the wings of the load plate and the sidewalls of the housing for resisting horizontal moving of the load plate during the connector being actuated in closed position, the stopping member comprising a plurality of holding sections and a corresponding number of protrusions engaging the holding sections, the protrusions engagingly retained in corresponding holding sections as the load plate being in closed position.

2. The electrical connector as claimed in claim 1, wherein the protrusions of the stopping member are formed on the opposite sidewalls of the housing corresponding the two wings of the load plate, while the holding sections are defined in the wings of the load plate, the holding sections being aligned with the protrusions.

3. The electrical connector as claimed in claim 2, wherein the protrusions are located on ends of the opposite sidewalls of the housing and near a side of the housing the load plate mounted thereon.

4. The electrical connector as claimed in claim 3, wherein the protrusions project symmetry from external surfaces of the opposite sidewalls of the housing.

5. The electrical connector as claimed in claim 4, wherein the protrusions are integratively formed with the housing.

6. The electrical connector as claimed in claim 5, wherein the protrusions have abutting surfaces adjacent the external surfaces of the sidewalls, the abutting surfaces abutting against the holding sections when the protrusions engagingly retained in the holding sections.

7. The electrical connector as claimed in claim 2, the holding sections defined in the wings are a plurality of separated slots along the wings of the load plate, while the protrusions projects outwardly from external surfaces of the sidewalls of the housing, the holding sections each engagingly retaining a corresponding protrusion therein when the load plate being in closed position.

8. The electrical connector as claimed in claim 1, the holding sections of the stopping member are a plurality of separated slots defined in the sidewalls of the housing, while the protrusions are formed on the wings of the load plate, the protrusions extending downwardly from the wings to the housing, the holding sections each engagingly retaining a corresponding protrusion therein when the load plate being in closed position.

* * * * *